US007012374B2

(12) United States Patent
Kurimoto et al.

(10) Patent No.: US 7,012,374 B2
(45) Date of Patent: Mar. 14, 2006

(54) HIGH-PRESSURE MERCURY LAMP, LAMP UNIT, AND IMAGE DISPLAY DEVICE

(75) Inventors: Yoshitaka Kurimoto, Takatsuki (JP); Yoshiki Kitahara, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 134 days.

(21) Appl. No.: 10/808,903

(22) Filed: Mar. 25, 2004

(65) Prior Publication Data

US 2004/0189208 A1 Sep. 30, 2004

(30) Foreign Application Priority Data

Mar. 31, 2003 (JP) ..... 2003-094961

(51) Int. Cl.
*H01J 17/20* (2006.01)

(52) U.S. Cl. ..... 313/637; 313/639

(58) Field of Classification Search ..... 313/484, 313/485, 567, 571, 576, 637–643
See application file for complete search history.

(56) References Cited

U.S. PATENT DOCUMENTS 3,783,328 A * 1/1974 Neumann ..... 313/579
5,109,181 A 4/1992 Fischer et al.
6,271,628 B1 8/2001 Sugitani et al.

FOREIGN PATENT DOCUMENTS

JP 11-149899 6/1999

* cited by examiner

*Primary Examiner*—Vip Patel
(74) *Attorney, Agent, or Firm*—Hamre, Schumann, Mueller & Larson, P.C.

(57) ABSTRACT

A high-pressure mercury lamp is provided that includes a transparent envelope made of quartz glass, in which mercury, halogen, and a rare gas are sealed and a pair of electrodes provided in the transparent envelope. The amount of the halogen sealed in the transparent envelope is in the range from $1.0\times10^{-6}$ $\mu$mol/mm$^3$ to $1.0\times10^{-2}$ $\mu$mol/mm$^3$, and 2.5 mol % to 25 mol % of oxygen with respect to the amount of the halogen is present in the transparent envelope. The high-pressure mercury lamp can prevent blackening of an inner wall of the transparent envelope from occurring over a long period of lighting without deteriorating the startability or lamp characteristics, thus achieving a long life.

9 Claims, 4 Drawing Sheets

HIGH-PRESSURE MERCURY LAMP, LAMP UNIT, AND IMAGE DISPLAY DEVICE

FIELD OF THE INVENTION

The present invention relates to a high-pressure mercury lamp, a lamp unit using the high-pressure mercury lamp, and an image display device using the lamp unit.

BACKGROUND OF THE INVENTION

As a system for projecting television or video images, or as a system for use in presentations using a personal computer, there have been known image display devices such as liquid crystal projectors and digital light processing (DLP) projectors. The image display devices of these types employ as a light source a high-pressure mercury lamp with a short arc structure, which is nearly identical to a point light source.

In general, a high-pressure mercury lamp includes a transparent envelope in which a pair of tungsten electrodes are arranged so as to substantially face each other, and mercury, halogen (e.g., bromine), and a rare gas are sealed. Halogen is sealed because it causes tungsten, as the electrode material, having evaporated from the electrodes heated to high temperatures to be re-deposited on the electrodes during lighting (this phenomenon is referred to as "halogen cycle"), thereby preventing the blackening of an inner wall of the transparent envelope due to the adhesion of the tungsten.

It is generally well known that the halogen cycle is accelerated when a trace amount of oxygen (O) is present in addition to halogen atoms X. This is because $WO_nX_m$ has a higher saturated vapor pressure than compounds represented by $W_nX_m$. However, it also is known that when an impure gas in the molecular state, e.g., oxygen ($O_2$), is present in the transparent envelope, the starting voltage of the lamp becomes high, which may cause a failure in starting the lamp.

Furthermore, the following problem also is known. When a considerable amount of oxygen is present with halogen in the transparent envelope, the tungsten electrodes are oxidized to accelerate the evaporation of the tungsten during lighting. The tips of the electrodes thus are eroded and/or deformed more considerably. As a result, the distance between the electrodes varies from the original, thereby deteriorating lamp characteristics. More specifically, because the distance between the electrodes becomes longer, increasing the luminance by adopting the short arc structure as originally intended becomes impossible.

On this account, in high-pressure discharge lamps including a high-pressure mercury lamp, in order to prevent an impure gas such as oxygen ($O_2$) from being present in a transparent envelope, processes for actively removing the impure gas have been performed conventionally. Specifically, as a material of a transparent envelope, high-purity quartz glass with an OH group content of not more than 5 ppm is used, for example. Furthermore, the quartz glass that has been formed and processed into the transparent envelope is heated at a high temperature in a vacuum to remove water ($H_2O$) impregnated into the quartz glass by a gas burner used when forming and processing the quartz glass. Also, electrodes are subjected to a hydrogen-reducing treatment to remove gases therefrom and/or heated at a high temperature in a vacuum, before being sealed in the transparent envelope. Furthermore, the process for sealing the electrodes in the transparent envelope is performed, for example, in an argon gas atmosphere, in order to prevent the electrodes from being oxidized by heating during this sealing process.

As described above, conventional high-pressure mercury lamps have been produced in such a manner that oxygen present in a transparent envelope is minimized. On the other hand, in order to prevent the blackening of an inner wall of the transparent envelope from occurring, reducing potassium (K), which is a factor inhibiting the halogen cycle, contained in components of a lamp, e.g., electrodes, has been proposed, as disclosed in JP 11(1999)-149899A, for example.

By the way, conventional high-pressure mercury lamps have a rated life of about 2000 hours. However, in recent years, long-life high-pressure mercury lamps having a rated life of 5000 hours are demanded for use as a light source in rear TVs, for example.

However, even the conventional high-pressure mercury lamps using high-purity electrodes with reduced content of potassium cannot achieve such a long life because the blackening of an inner wall of the transparent envelope, especially at portions near the electrodes, occurs after 3000 hours of lighting. The blackening causes the transparent envelope to be heated abnormally, which may result in the breakage of the transparent envelope.

Furthermore, some image display devices (projectors) have a light control function according to the following two modes: a normal mode in which a high-pressure mercury lamp is operated at a rated power (e.g., 220 W) and an energy-saving mode in which a power lower than the rated power is input to the high-pressure mercury lamp to make the luminance lower than in the normal mode. However, according to the conventional high-pressure mercury lamps, the following problem arises. That is, when such a light control function is used, i.e., when the high-pressure mercury lamps are operated at a power lower than the rated power, the blackening of an inner wall of the transparent envelope, especially at portions near the electrodes, becomes considerable as compared with the case where the lamps are operated at the rating power, so that the life of the lamps is shortened when operated in the energy-saving mode (i.e., at the lower power).

SUMMARY OF THE INVENTION

Therefore, with the foregoing in mind, it is an object of the present invention to provide a high-pressure mercury lamp capable of preventing the blackening of an inner wall of a transparent envelope from occurring over a long period of lighting without deteriorating the startability or lamp characteristics, thus achieving a long life. Furthermore, it is another object of the present invention to provide a lamp unit using such a high-pressure mercury lamp and an image display device using such a lamp unit.

A high-pressure mercury lamp according to the present invention includes: a transparent envelope made of quartz glass, in which mercury, halogen, and a rare gas are sealed; and a pair of electrodes provided in the transparent envelope. In this high-pressure mercury lamp, an amount of the halogen sealed in the transparent envelope is in the range from $1.0\times10^{-6}$ $\mu$mol/mm$^3$ to $1.0\times10^{-2}$ $\mu$mol/mm$^3$, and 2.5 mol % to 25 mol % of oxygen with respect to the amount of the halogen is present in the transparent envelope.

These and other advantages of the present invention will become apparent to those skilled in the art upon reading and understanding the following detailed description with reference to the accompanying figures.

DESCRIPTION OF THE PREFERRED EMBODIMENTS

Figure 1:
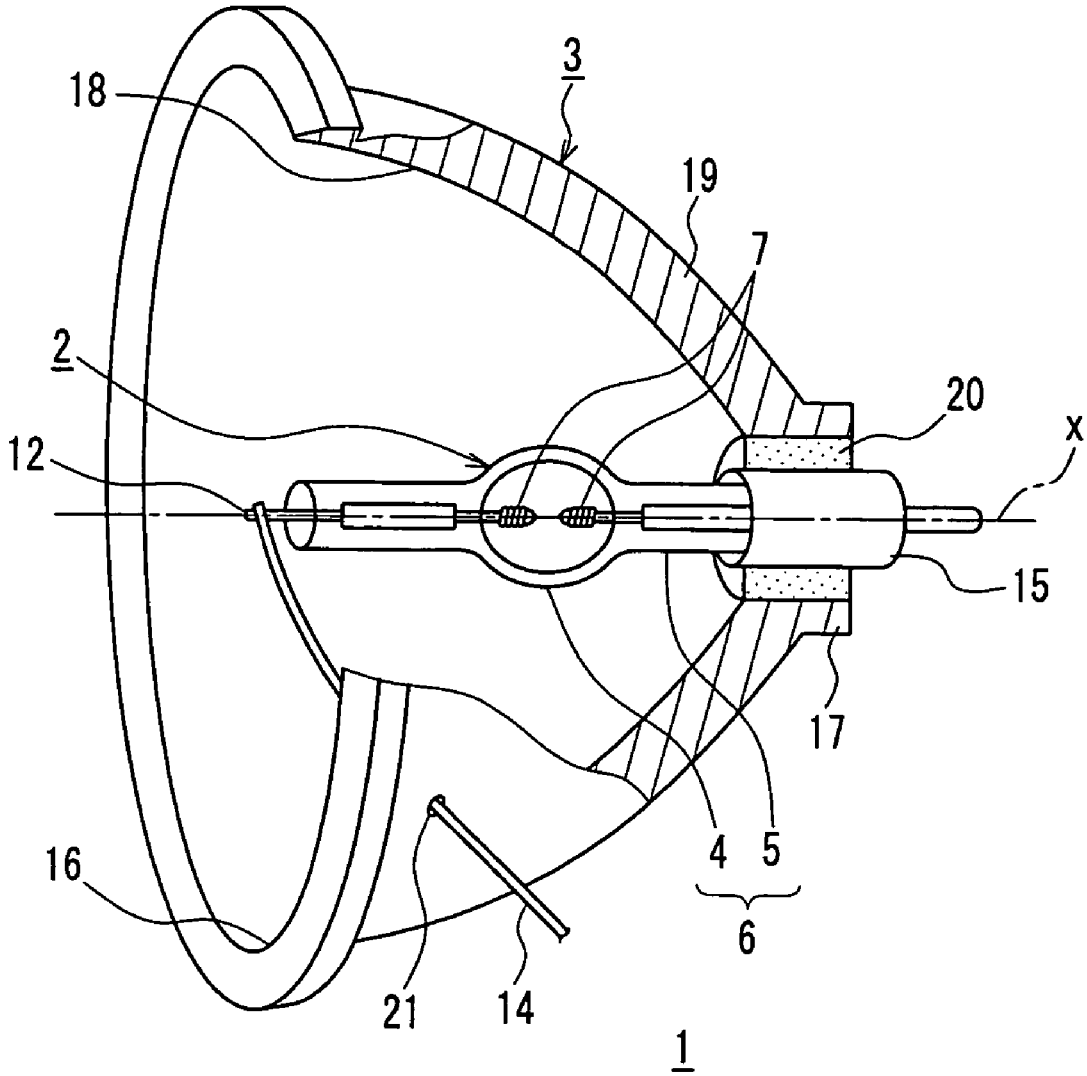
FIG. 1 is a partially cutaway view of a lamp unit for use in a projector, according to one embodiment of the present invention.

In a high-pressure mercury lamp according to the present invention, an amount of halogen sealed in a transparent envelope is specified, and a ratio of the number of oxygen atoms to the number of halogen atoms also is specified. Thus, the combination of the amount of the halogen and the amount of the oxygen sealed in the transparent envelope is optimized, thereby suppressing the failure in starting the lamp due to the oxygen present in the transparent envelope and the deterioration of lamp characteristics. In addition, the halogen cycle is allowed to function extremely favorably, so that the blackening of an inner wall of the transparent envelope, especially at portions near electrodes, is prevented from occurring over a long period of lighting, resulting in a long life of the lamp.

As the halogen, chlorine, bromine, and iodine can be used. However, it is preferable to use bromine because it has a particularly small erosive action to the electrodes.

The high-pressure mercury lamp according to the present invention extremely is suitable as a high-pressure mercury lamp capable of performing a light control operation in which the high-pressure mercury lamp is operated at a power lower than a rated power, e.g., a power not more than 85% of the rated power. The reason for this is as follows. When a high-pressure mercury lamp is operated at the rating power, the temperature of an inner wall of a transparent envelope is sufficiently high, which allows a compound of tungsten and halogen to evaporate easily. Thus, the halogen cycle can function sufficiently. On the other hand, when a high-pressure mercury lamp is operated at the lower power, in particular, at a power not more than 85% of the rated power, the temperature of an inner wall of a transparent envelope becomes low. As a result, a compound of tungsten and halogen is less prone to evaporate and thus remains adhered to the inner wall of the transparent envelope. In contrast, according to the high-pressure mercury lamp of the present invention, the above-described problem can be prevented from occurring because the halogen cycle is allowed to function extremely favorably.

Furthermore, the above-described configuration of the high-pressure mercury lamp is still more suitable as a high-pressure mercury lamp with a rated power of 200 W or more, which includes a large transparent envelope and thus the temperature of an inner wall of the transparent envelope differs greatly between the operation at the rated power and the operation at a power lower than the rated power.

Furthermore, the above-described configuration of the high-pressure mercury lamp is particularly suitable in the case where the transparent envelope is substantially spherical or substantially spheroidal, the pair of electrodes are arranged so as to substantially face each other, and the following relationships are satisfied: $L \leqq 2.0$ mm, $r/L > 5$, where L (mm) denotes a distance between the electrodes and r (mm) denotes a maximum inner diameter of the transparent envelope in the longitudinal direction of the electrodes.

The reason for this is as follows. The above-described difference in temperature of the inner wall of the transparent envelope is considerable particularly at portions near the electrodes. This is because, when the high-pressure mercury lamp is operated in the state where the lamp is arranged so that the longitudinal direction of the lamp runs horizontally, the base portion of each electrode generally has the lowest temperature. Thus, in the high-pressure mercury lamp with the above-described configuration, the temperature of the bases portions of the electrodes is considerably low and the blackening is more liable to occur at these portions. However, by applying the present invention, it is possible to suppress the blackening sufficiently.

Preferably, a content of potassium in the electrodes is not more than 10 ppm, in order to eliminate a factor inhibiting the halogen cycle, thereby allowing the halogen cycle to function still more favorably.

Furthermore, a lamp unit according to the present invention includes: a concave reflecting mirror; and a high-pressure mercury lamp with any one of the above-described configurations, attached to the concave reflecting mirror. The high-pressure mercury lamp is attached so that the midpoint between the pair of electrodes substantially coincides with a focal position of the concave reflecting mirror.

Furthermore, an image display device according to the present invention includes: a lamp unit having the above-described configuration; a circuit for operating a high-pressure mercury lamp included in the lamp unit; converging means for converging light emitted from the lamp unit; image forming means for forming an image using the light converged by the converging means; and projecting means for projecting the image formed by the image forming means on a projection member.

Hereinafter, one embodiment of the present invention will be described with reference to the accompanying drawings.

FIG. 1 shows a lamp unit 1 for use in a projector, employing a high-pressure mercury lamp 2 according to one embodiment of the present invention. The lamp unit 1 includes a concave reflecting mirror 3 and the high-pressure mercury lamp 2 attached to the concave reflecting mirror 3. The high-pressure mercury lamp 2 is arranged so that the midpoint between electrodes 7 substantially coincides with a focal position of the concave reflecting mirror 3 and that the central axis X of the high-pressure mercury lamp 2 in its longitudinal direction is substantially in parallel with the optical axis (which is the same as the central axis X in FIG. 1) of the concave reflecting mirror 3. The high-pressure mercury lamp 2 is a light control function compatible type, and is operated at a rated power of 220 W (at 180 W when operated at a lower power) by applying an alternating voltage, for example.

Figure 2:
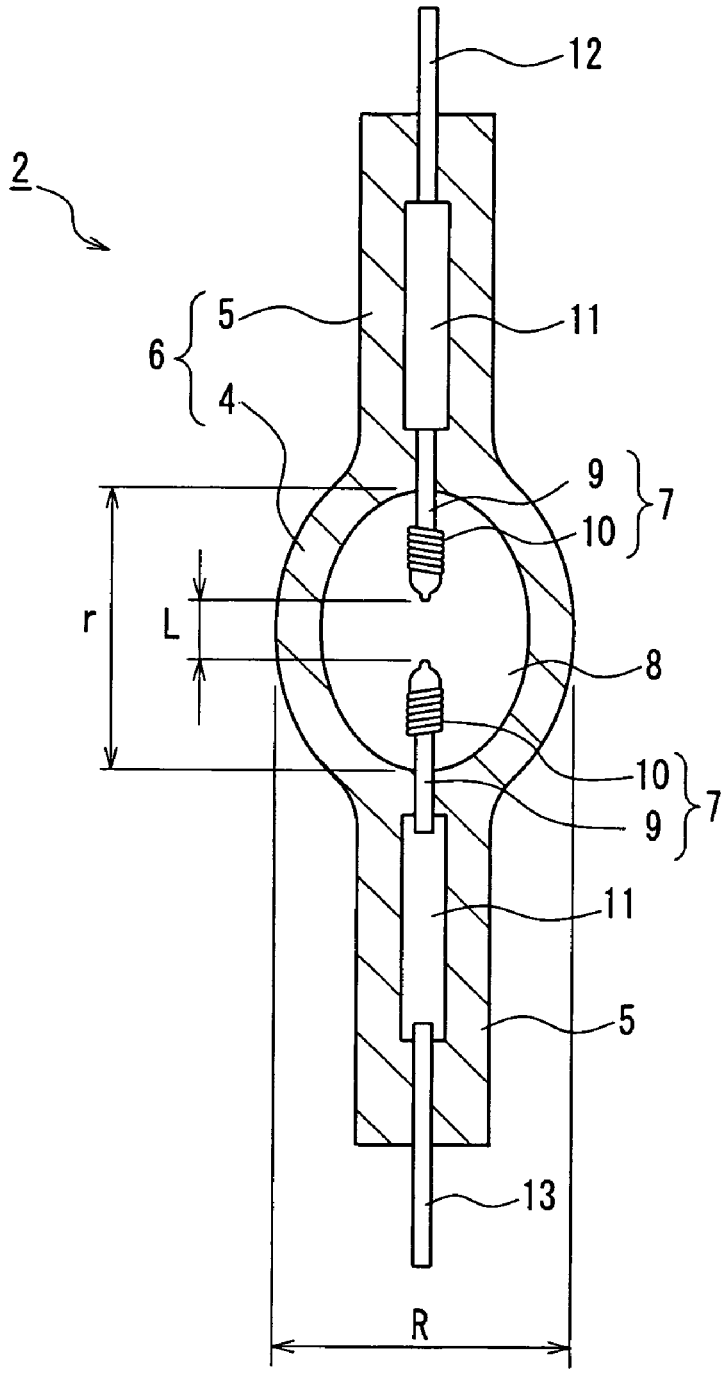
FIG. 2 is a cross-sectional front view of a high-pressure mercury lamp used in the lamp unit for use in a projector.

As shown in FIG. 2, the high-pressure mercury lamp 2 includes a transparent envelope 6 made of quartz glass having a light-emitting part 4 and sealing parts 5 provided on both ends of the light-emitting part 4. In the light-emitting part 4, a discharge space 8 is formed and a pair of electrodes 7 are arranged so as to substantially face each other. The external shape of the light-emitting part 4 is either substantially spherical or substantially spheroidal, and the maximum outer diameter R is 12 mm and the maximum inner diameter r in the longitudinal direction of the electrodes 7 is 10.7 mm. Each of the sealing parts 5 has a cylindrical shape with a diameter of 6 mm. The internal volume of the transparent envelope 6 (the light-emitting part 4) is, for example, 0.2 cc. Furthermore, quartz glass used for forming the transparent envelope 6 has an OH group content of not more than 5 ppm.

During lighting, an inner wall of the transparent envelope 6 (the light-emitting part 4) is subjected to a wall load of at least 80 W/cm$^2$, e.g., 140 W/cm$^2$. When the transparent envelope 6 is made of quartz glass, a wall road of not more than 200 W/cm$^2$ is preferable for actual use.

Inside the light-emitting part 4, mercury (light-emitting material), a rare gas such as argon gas or xenon gas, and halogen such as bromine are sealed. The amount of the mercury sealed in the light-emitting part 4 is at least 0.15 mg/mm$^3$ and preferably is not more than 0.35 mg/mm$^3$ for actual use. The amount of the rare gas sealed in the light-emitting part 4 is about 5 kPa to 40 kPa. The amount of the halogen sealed in the light-emitting part 4 is $10^{-6}$ $\mu$mol/mm$^3$ to $10^{-2}$ $\mu$mol/mm$^3$.

Each of the electrodes 7 has an electrode rod 9 and a coil 10 wound in two tiers around one end of the electrode rod 9. The electrode rod 9 contains tungsten as a main component, and the content of potassium (K) as an impurity is not more than 10 ppm, e.g., 5 ppm. The electrode rod 9 is 0.3 mm to 0.45 mm in diameter. The coil 10 is made of the same material as that of the electrode rod 9. At the tip of each electrode 7, a part of the coil 10 and a part of the electrode rod 9 are molten, thereby forming a mass having a substantially hemispherical shape. The distance L between the electrodes 7 is in the range from 0.2 mm to 5.0 mm and is, for example, 1.5 mm. Thus, this high-pressure mercury lamp 2 satisfies the relationships expressed as $L \leqq 2.0$ mm and $r/L > 5$, where L (mm) denotes a distance between the electrodes 7 and r (mm) denotes a maximum inner diameter of the transparent envelope 6 in the longitudinal direction of the electrodes 7 (see FIG. 2).

The other ends of the electrode rods 9 are electrically connected to molybdenum outer leads 12 and 13, respectively, via molybdenum foils 11 sealed in the sealing parts 5. The outer leads 12 and 13 extend to the outside of the transparent envelope 6.

As shown in FIG. 1, the outer lead 12 connected to one electrode rod 9 is electrically connected to a power supply line 14 that extends to the outside of the concave reflecting mirror 3 via a through hole 21 formed in the concave reflecting mirror 3. On the other hand, the outer lead 13 (not shown in FIG. 1) connected to the other electrode rod 9 is electrically connected to a metal base 15 that is fixed to an end portion of the high-pressure mercury lamp 2 with an adhesive (not shown) or the like.

The concave reflecting mirror 3 includes an opening 16 on the front side thereof, a neck 17 on the rear side thereof, and a main body 19 having a reflection surface 18 formed on its inner wall. The reflection surface 18 is a paraboloid of revolution or an ellipsoid of revolution, for example.

The base 15 fixed to the high-pressure mercury lamp 2 is attached to the neck 17 and then fixed thereto with an adhesive 20 or the like, thus integrating the high-pressure mercury lamp 2 with the concave reflecting mirror 3. The main body 19 has the through hole 21 for allowing the power supply line 14 to extent to the outside of the concave reflecting mirror 3. Generally, a front glass is attached to the opening 16, although it is not shown in the drawing.

Figure 3:
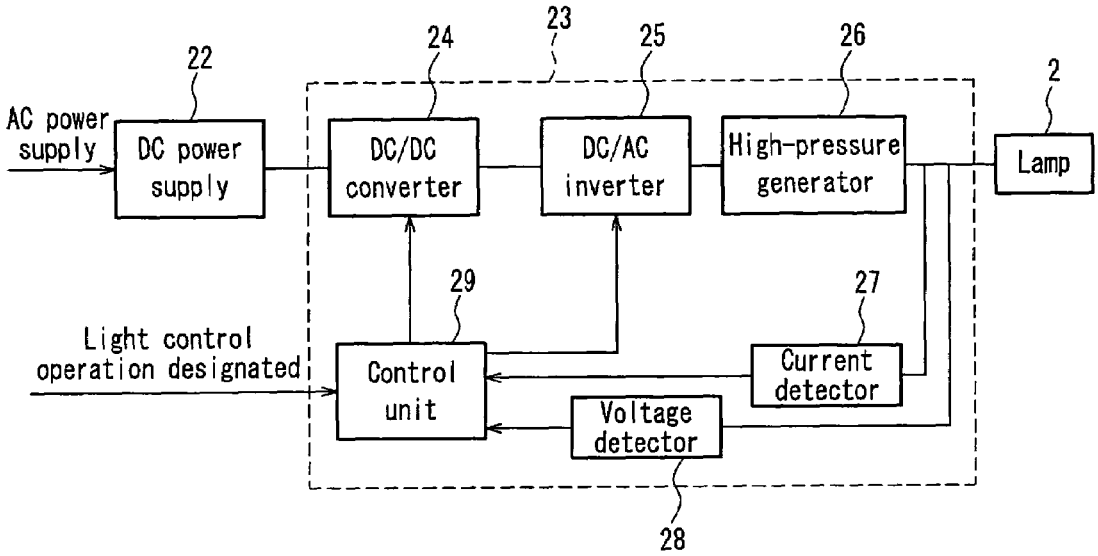
FIG. 3 is a block diagram showing a configuration of a lighting device.

Hereinafter, a lighting device for operating the high-pressure mercury lamp 2 will be described. As shown in FIG. 3, the lighting device includes a direct current power supply (DC power supply) 22 to be connected to an alternating current power supply (AC 100 V) (not shown) and a ballast 23 connected to this direct current power supply 22 and to the high-pressure mercury lamp 2.

The ballast 23 includes: a DC/DC converter 24 for supplying a power necessary for operating the high-pressure mercury lamp 2; a DC/AC inverter 25 for converting an output from the DC/DC converter 24 into an alternating current with a predetermined frequency; a high-pressure generator 26 for superimposing a high-voltage pulse on the high-pressure mercury lamp 2 when starting the lamp; a current detector 27 for detecting a lamp current of the high-pressure mercury lamp 2; a voltage detector 28 for detecting a lamp voltage of the high-pressure mercury lamp 2; and a control unit 29 for controlling the DC/DC converter 24 and the DC/AC inverter 25 based on detection signals from the current detector 27 and the voltage detector 28.

When dielectric breakdown is caused between the electrodes 7 of the high-pressure mercury lamp 2 to allow an arc discharge current to flow between the electrodes 7, the current detector 27 transmits a detection signal to the control unit 29. The lighting judgment circuit provided in the control unit 29 judges that "the high-pressure mercury lamp 2 is turned on" upon receipt of the detection signal. After the high-pressure mercury lamp 2 is turned on, the control unit 29 transmits a signal to the DC/DC converter 24 based on detection signals from the current detector 27 and the voltage detector 28 to control a power at which the high-pressure mercury lamp 2 is operated. This control is constant power control, and the product of a current value detected by the current detector 27 and a voltage value detected by the voltage detector 28 is compared with a reference value for power stored in an internal memory of the control unit 29 to control a current output from the DC/DC converter 24 so as to be constant. To the control unit 29, a switch (not shown) for designating a light control operation, which is provided outside the ballast, is connected. When the light control operation is designated, the reference value of power is switched to perform the light control operation.

Figure 4:
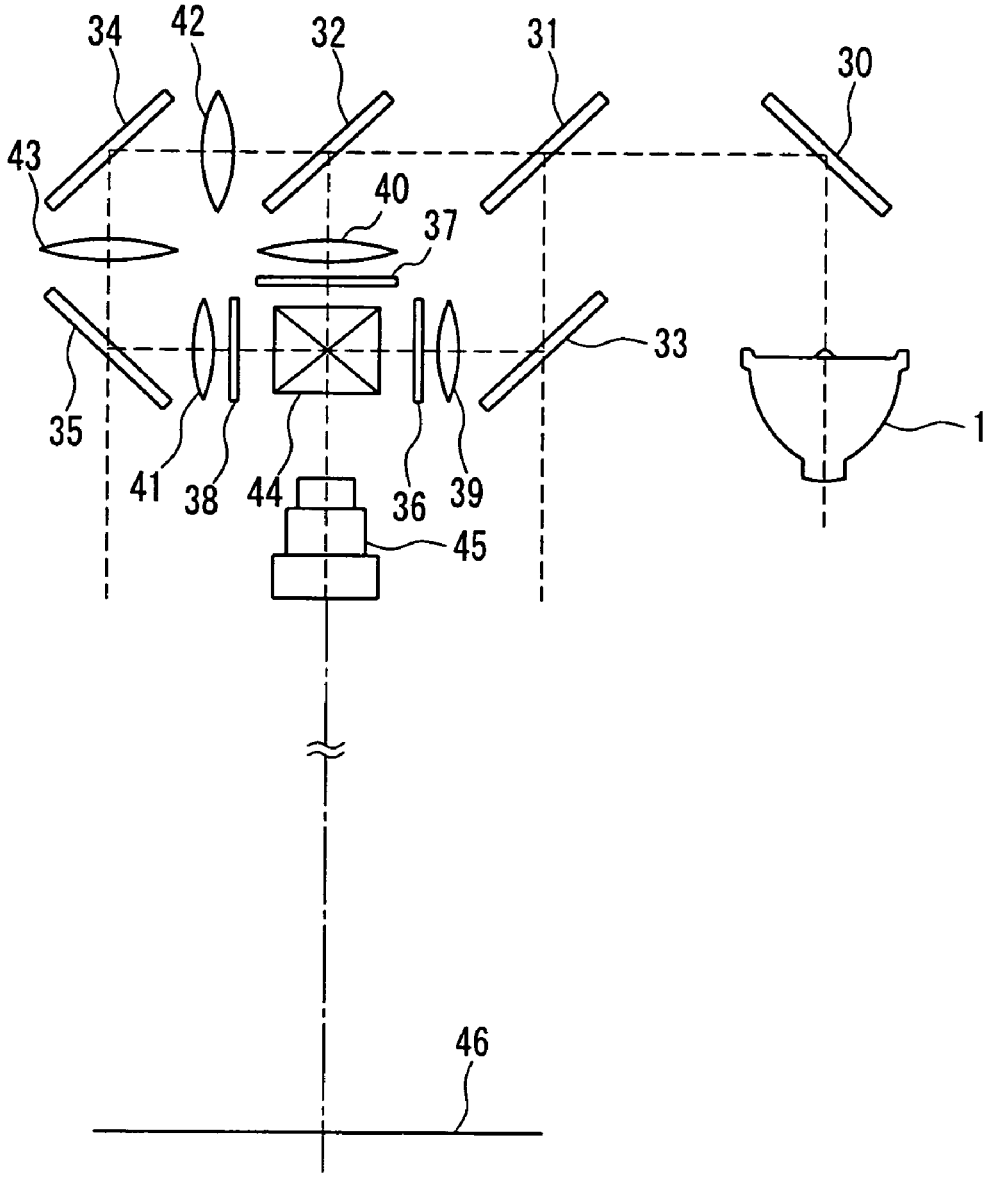
FIG. 4 is a schematic view of an image display device, in which the lamp unit for use in a projector according to one embodiment of the present invention is used.

As one example of an image display device using the above-described lamp unit 1, a three-plate liquid crystal projector will be described with reference to FIG. 4. This image display device includes: the lamp unit 1 as a light source; a mirror 30; dichroic mirrors 31 and 32 for separating white light emitted from the lamp unit 1 into light beams of three primary colors of blue, green, and red; mirrors 33, 34, and 35 for reflecting the thus-obtained light beams, respectively; liquid crystal light valves 36, 37, and 38 for forming monochromatic light images of the respective light beams of three primary colors; field lenses 39, 40, and 41; relay lenses 42 and 43; a dichroic prism 44 for overlaying the light beams having passed through the liquid crystal light valves 36, 37, and 38, respectively; and a projection lens 45. An image output from the image display device is projected on a screen 46. In this image display device, components other than the lamp unit 1 have known configurations. Thus, the illustration of optical elements such as a UV filter is omitted in FIG. 4.

Hereinafter, the reason why the amount of oxygen (O) sealed in the transparent envelope is specified within the range from 2.5 mol % to 25 mol % with respect to the amount of bromine (Br) ($1.0\times10^{-6}$ $\mu$mol/mm$^3$ to $1.0\times10^{-2}$ $\mu$mol/mm$^3$) sealed in the transparent envelope will be described.

High-pressure mercury lamps 2 having the above-described configuration were produced with various amounts of bromine and oxygen sealed in the transparent envelopes. More specifically, the amounts of the bromine sealed in the transparent envelopes were set to $1.0\times10^{-8}$ $\mu$mol/mm$^3$, $1.0\times10^{-6}$ $\mu$mol/mm$^3$, $1.0\times10^{-4}$ $\mu$mol/mm$^3$, $1.0\times10^{-2}$ $\mu$mol/mm$^3$, and $1.0\times10^{1}$ $\mu$mol/mm$^3$. With respect to each amount of bromine, the amount of the oxygen was varied within the range from 2.0 mol % to 30 mol %. For each combination of the amount of bromine and the amount of oxygen, 5 high-pressure mercury lamps were produced.

The high-pressure mercury lamps thus produced were started by applying a starting pulse voltage with a full width at half maximum of 100 nsec and a peak value of 10 kV and operated by applying a rectangular waveform voltage of 200 Hz frequency to evaluate lamp characteristics. More specifically, with regard to the operation at the rated power (220 W) and the operation at a lower power (180 W), illuminance maintenance factors (%) of each lamp after 3000 hours and 5000 hours of lighting were determined by setting the illuminance after 5 hours of lighting as 100 %. The results are shown in Table 1 below.

It is to be noted that the "illuminance maintenance factor" as used herein refers to an average illuminance maintenance factor (%) determined by projecting light onto a 40-inch screen using the image display device. The illuminance maintenance factor was evaluated based on the following criteria. That is, from a practical standpoint, the illuminance maintenance factor of 50% or more after 5000 hours of lighting was evaluated as "good" in the operations at both the rated power and the lower power. In addition, the startability of the high-pressure mercury lamps also was confirmed by checking whether or not the high-pressure mercury lamps were started by applying the above-described starting voltage. The results thereof also were shown in Table 1.

In Table 1, illuminance maintenance factors $A_1$ and $B_1$ show values after 3000 hours of lighting, and illuminance maintenance factors $A_2$ and $B_2$ show values after 5000 hours of lighting.

TABLE 1

| Bramount ($\mu$mol/mm$^3$) | O amount relative to Bramount (mol %) | Operation at rated power (220 W) Illuminance maintenance factor (%) $A_1$ | Operation at rated power (220 W) Illuminance maintenance factor (%) $A_2$ | Operation at lower power (180 W) Illuminance maintenance factor (%) $B_1$ | Operation at lower power (180 W) Illuminance maintenance factor (%) $B_2$ | Startability | Total |
|---|---|---|---|---|---|---|---|
| $1.0 \times 10^{-8}$ | 2.0 | 46.0 | 38.0 | 46.6 | 34.3 | good | not good |
| | 2.5 | 45.6 | 33.1 | 46.0 | 38.9 | good | not good |
| | 5 | 41.0 | 33.3 | 37.5 | 36.3 | good | not good |
| | 10 | 46.4 | 35.8 | 43.5 | 36.0 | good | not good |
| | 25 | 44.2 | 43.0 | 46.3 | 46.1 | good | not good |
| | 30 | 47.5 | 43.8 | 42.4 | 40.0 | good | not good |
| $1.0 \times 10^{-6}$ | 2.0 | 71.7 | 57.3 | 46.2 | 45.3 | good | not good |
| | 2.5 | 67.7 | 61.6 | 72.4 | 64.4 | good | good |
| | 5 | 71.6 | 59.7 | 76.5 | 67.5 | good | good |
| | 10 | 72.9 | 57.5 | 75.6 | 64.8 | good | good |
| | 25 | 70.5 | 58.0 | 74.0 | 67.4 | good | good |
| | 30 | 40.2 | 38.5 | 46.3 | 40.5 | good | not good |
| $1.0 \times 10^{-4}$ | 2.0 | 70.0 | 62.0 | 42.3 | 41.8 | good | not good |
| | 2.5 | 68.6 | 59.1 | 76.6 | 67.4 | good | good |
| | 5 | 68.8 | 58.1 | 77.7 | 66.0 | good | good |
| | 10 | 67.8 | 59.8 | 77.1 | 64.2 | good | good |
| | 25 | 71.8 | 57.5 | 75.3 | 62.9 | good | good |
| | 30 | 44.3 | 43.9 | 38.6 | 33.1 | good | not good |
| $1.0 \times 10^{-2}$ | 2.0 | 67.7 | 60.8 | 38.6 | 37.6 | good | not good |
| | 2.5 | 68.2 | 62.9 | 76.4 | 64.7 | good | good |
| | 5 | 68.7 | 61.3 | 73.2 | 67.9 | good | good |
| | 10 | 68.7 | 59.9 | 72.9 | 65.4 | good | good |
| | 25 | 67.6 | 58.1 | 76.9 | 62.7 | good | good |
| | 30 | 45.9 | 41.4 | 47.3 | 45.7 | good | not good |
| $1.0 \times 10^{-1}$ | 2.0 | 45.4 | 36.0 | 40.9 | 33.7 | good | not good |
| | 2.5 | 43.1 | 41.5 | 44.3 | 40.1 | good | not good |
| | 5 | 38.2 | 37.8 | 36.5 | 32.9 | good | not good |
| | 10 | 42.1 | 34.0 | 42.5 | 33.9 | good | not good |
| | 25 | 36.6 | 35.8 | 41.9 | 39.6 | good | not good |
| | 30 | 41.6 | 39.7 | 44.7 | 40.6 | good | not good |

As can be seen from Table 1, when the amount of the bromine sealed in the transparent envelope was in the range of $1.0\times10^{-6}$ $\mu$mol/mm$^3$ to $1.0\times10^{-2}$ $\mu$mol/mm$^3$, and the amount of the oxygen sealed in the transparent envelope was in the range from 2.5 mol % to 25 mol % with respect to the amount of the bromine, the high-pressure mercury lamps achieved the illuminance maintenance factors satisfying the above-described evaluation criteria and also exhibited a favorable startability.

The reason for this is considered to be as follows. In the above-described high-pressure mercury lamps, the combination of the amount of the bromine and the amount of the oxygen sealed in the transparent envelope was optimized, thereby allowing halogen cycle to function extremely favorably while minimizing the amount of oxygen. As a result, a favorable startability was obtained, and at the same time, the blackening of an inner wall of the transparent envelope was suppressed to improve the illuminance maintenance factors of the lamps.

In contrast, even if the amount of the bromine sealed in the transparent envelope was in the range from $1.0\times10^{-6}$ $\mu$mol/mm$^3$ to $1.0\times10^{-2}$ $\mu$mol/mm$^3$, when the amount of the oxygen sealed in the transparent envelope was less than 2.5 mol %, e.g., 2.0 mol %, with respect to the amount of the bromine, the high-pressure mercury lamps did not achieve the illuminance maintenance factor satisfying the above-described evaluation criteria when operated at the lower power, although they exhibited a favorable startability and achieved the illuminance maintenance factor satisfying the above-described evaluation criteria when operated at the rated power.

The reason for this is considered to be as follows. The temperature of the inner wall of the transparent envelope 6 in the operation at the lower power was lower than that in the operation at the rated power. Thus, when the high-pressure mercury lamps were operated at the lower power, the tungsten having evaporated from the electrodes 7 adhered to the inner wall of the transparent envelope 6, especially at portions near the electrodes 7, thereby causing blackening.

Furthermore, even if the amount of the bromine sealed in the transparent envelope was in the range from $1.0\times10^{-6}$ $\mu$mol/mm$^3$ to $1.0\times10^{-2}$ $\mu$mol/mm$^3$, when the amount of the oxygen sealed in the transparent envelope was more than 25 mol %, e.g., 30 mol % with respect to the amount of the bromine, the high-pressure mercury lamps did not achieve the illuminance maintenance factors satisfying the above-described evaluation criteria in the operation at either the rated power or the lower power, although the startability was favorable.

The reason for this is considered to be as follows. Although the occurrence of the blackening could hardly be confirmed by visual observation, the electrodes 7 were eroded and/or deformed due to oxidization, so that the distance between the electrodes 7 or the like varied from the original, thereby decreasing the luminance.

On the other hand, when the amount of the bromine sealed in the transparent envelope was less than $1.0\times10^{-6}$ $\mu$mol/mm$^3$, even if the amount of the oxygen sealed in the transparent envelope was in the range from 2.5 mol % to 25 mol % with respect to the amount of the bromine, the high-pressure mercury lamps failed to achieve the illuminance maintenance factors satisfying the above-described evaluation criteria in the operations at both the rated power and the lower power, although the startability was favorable.

The reason for this is considered to be that halogen cycle did not function sufficiently.

Furthermore, when the amount of the bromine sealed in the transparent envelope was more than $1.0\times10^{-6}$ $\mu$mol/mm$^3$, even if the amount of the oxygen sealed in the transparent envelope was in the range from 2.5 mol % to 25 mol % with respect to the amount of the bromine, the high-pressure mercury lamps failed to achieve the illuminance maintenance factors satisfying the above-described evaluation criteria in the operations at both the rated power and the lower power, although the startability was favorable.

The reason for this is considered to be as follows. Since the amount of the bromine sealed in the transparent envelope was too much, the electrodes 7 were eroded by the bromine so that the distance between the electrodes 7 varied from the original, thereby decreasing the luminance.

For the above-described reasons, the amount of the bromine sealed in the transparent envelope was specified within the range from $1.0\times10^{-6}$ $\mu$mol/mm$^3$ to $1.0\times10^{-2}$ $\mu$mol/mm$^3$, and the amount of the oxygen sealed in the transparent envelope is specified within the range from 2.5 mol % to 25 mol % with respect to the amount of the bromine.

As specifically described above, with the configuration of the high-pressure mercury lamp 2 according to one embodiment of the present invention, the combination of the amount of the bromine and the amount of the oxygen sealed in the transparent envelope is optimized, thereby suppressing the failure in starting the high-pressure mercury lamp due to the oxygen present in the transparent envelope 6 and the deterioration of lamp characteristics (luminance). In addition, the halogen cycle is allowed to function extremely favorably, so that the blackening of the inner wall of the transparent envelope, especially at portions near the electrodes, is prevented from occurring over a long period of lighting, resulting in a long life of the lamp.

A high-pressure mercury lamp with very little occurrence of such blackening can improve an illuminance maintenance factor. Thus, by employing such a high-pressure mercury lamp, a long-life lamp unit 1 and also a ling-life image display device can be obtained.

While the above-described embodiment is directed to the high-pressure mercury lamp 2 with a rated power of 220 W (180 W when operated at a power lower than the rated power), the present invention also is applicable to a high-pressure mercury lamp with a rated power of 200 W, 150 W, 120 W, or the like, for example.

Also, while the above-described embodiment is directed to an example where a high-pressure mercury lamp is started by applying a starting pulse voltage with a full width at half maximum of 100 nsec and a peak value of 10 kV and operated by applying a rectangular waveform voltage of 200 Hz frequency, the same effect as described above can be obtained even when a high-pressure mercury lamp is started by applying a starting pulse voltage with a full width at half maximum of 1 nsec to 100 $\mu$sec and a peak value of 2 kV to 20 kV and operated by applying a rectangular waveform voltage of 50 Hz to 10 kHz frequency. The waveform of the voltage is not limited to rectangular and may be, for example, sinusoidal, triangular, and any other distorted forms, and the effect of the invention as described above can be obtained regardless of the waveform.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A high-pressure mercury lamp comprising:

a transparent envelope made of quartz glass, in which mercury, halogen, and a rare gas are sealed; and a pair of electrodes provided in the transparent envelope, wherein an amount of the halogen sealed in the transparent envelope is in a range from $1.0\times10^{-6}$ $\mu$mol/mm$^3$ to $1.0\times10^{-2}$ $\mu$mol/mm$^3$, and 2.5 mol % to 25 mol % of oxygen with respect to the amount of the halogen is present in the transparent envelope.

2. The high-pressure mercury lamp according to claim 1, wherein the halogen is bromine.

3. The high-pressure mercury lamp according to claim 1, capable of performing a light control operation in which the high-pressure mercury lamp is operated at a power lower than a rated power.

4. The high-pressure mercury lamp according to claim 3, wherein the power lower than the rated power is a power not more than 85% of the rated power.

5. The high-pressure mercury lamp according to claim 3, wherein the rated power is 200 W or more.

6. The high-pressure mercury lamp according to claim 5, wherein the transparent envelope is substantially spherical or substantially spheroidal, the pair of electrodes are arranged so as to substantially face each other, and the following relationships are satisfied:

$$L \leqq 2.0 \text{ mm}, \ r/L > 5$$

where L (mm) denotes a distance between the electrodes and r (mm) denotes a maximum inner diameter of the transparent envelope in the longitudinal direction of the electrodes.

7. The high-pressure mercury lamp according to claim 1, wherein a content of potassium in the electrodes is not more than 10 ppm.

8. A lamp unit comprising:

a concave reflecting mirror; and the high-pressure mercury lamp according to claim 1 attached to the concave reflecting mirror, wherein the high-pressure mercury lamp is attached so that a midpoint between the pair of electrodes substantially coincides with a focal position of the concave reflecting mirror.

9. An image display device comprising:

the lamp unit according to claim 8;

a circuit for operating the high-pressure mercury lamp included in the lamp unit;

converging means for converging light emitted from the lamp unit;

image forming means for forming an image using the light converged by the converging means; and projecting means for projecting the image formed by the image forming means on a projection member.

* * * * *